United States Patent [19]

Grossi

[11] Patent Number: 5,064,092

[45] Date of Patent: Nov. 12, 1991

[54] DEVICE FOR AN AUTOMATIC DISPENSING OF PACKAGED PRODUCTS

[76] Inventor: Lucio Grossi, Via Sylva 30, Bergamo, Italy

[21] Appl. No.: 526,227

[22] Filed: May 21, 1990

[30] Foreign Application Priority Data

Jun. 1, 1989 [IT] Italy ..... 20731 A/89

[51] Int. Cl.[5] ..... G07F 11/24

[52] U.S. Cl. ..... 221/75; 221/258; 221/277

[58] Field of Search ..... 221/75, 124, 195, 258, 221/277, 289

[56] References Cited

U.S. PATENT DOCUMENTS

| | | | |
|---|---|---|---|
| 2,028,787 | 1/1936 | Lane | 221/258 X |
| 3,815,781 | 6/1974 | Armstrong et al. | 221/75 |
| 3,828,970 | 8/1974 | Yamamoto | 221/289 X |
| 3,883,039 | 5/1975 | Wittern et al. | 221/75 |
| 4,061,245 | 12/1977 | Lotspeich | 221/75 |
| 4,149,653 | 4/1979 | Lennartson | 221/75 |
| 4,560,086 | 12/1985 | Stol | 221/75 X |
| 4,671,426 | 6/1987 | Grossi | 221/75 |
| 4,889,259 | 12/1989 | Lowrance et al. | 221/75 |
| 4,950,120 | 8/1990 | Barnes | 221/75 X |

*Primary Examiner*—Robert P. Olszewski
*Assistant Examiner*—Dean A. Reichard
*Attorney, Agent, or Firm*—Herbert Dubno

[57] ABSTRACT

Device for the automatic dispensing of packaged products, including a number of vertical plane surfaces arranged together and having a "U" shape cross section for forming a dispensing chamber within which a spiral element is located having turns spaced apart, the product being placed between two adjacent and thus being supported by the spiral which is caused to rotate in order to dispense the product, which is prevented from rotating by at least one of the walls of the dispensing chamber, the spiral consisting of a number of turns between which are placed additional products, thus forming a vertically arranged store.

5 Claims, 3 Drawing Sheets

DEVICE FOR AN AUTOMATIC DISPENSING OF PACKAGED PRODUCTS

FIELD OF THE INVENTION

The present invention relates to a device including a rotating helical element for the automatic dispensing of packaged products which have at least one dimension of the packages greater than other dimensions thereof.

BACKGROUND OF THE INVENTION

In the technology of automatic machines for dispensing packaged products there are known numerous devices which, following the insertion of a coin or the like, enable the product to be brought to a storage area located adjacent to an underlying area for collection by the user.

In particular, there are known embodiments with, for example, a gravity feed, which are highly compact but require the shape of the objects to be regular and of constant dimensions. There are also embodiments with a screw feed, although these devices have large overall dimensions and do not permit adaptation to different dimensions of the objects contained, thus making the optimization of the load difficult.

OBJECTS OF THE INVENTION

It is heretofore the object of the present invention to provide a dispensing device for objects in automatic machines which has small overall dimensions.

Still another object of the invention is to provide the aforementioned device for rapidly varying the volume of the storage and dispensing areas in order to permit the dispensing of packaged products of different volumes as commanded, and with the dimensions of the objects varying widely and which does not cause damage to the objects.

Finally, another object of the invention is to provide a device which is also easily installed and does not require maintenance when in operation.

SUMMARY OF THE INVENTION

These objects are met by the present invention, which includes a device for the automatic dispensing of packaged products, comprising a number of vertical plane surfaces arranged together in the shape of a "U" and forming a dispensing chamber within which is located a spiral (helical) element with a vertical axis and having spaces between its turns. The product is located between two such adjacent turns so that it is supported by the spiral, which is caused to rotate in order to effect the dispensing of the product. The latter is prevented from rotating by at least one of the walls of the dispensing chamber, the spiral consisting of a number of turns between which other products are located, thus forming an ordered vertical store.

The plane surfaces are slidable with respect to each other and to the walls of the dispensing machine, thus permitting the rapid variation of the overall volume of the dispensing chamber to match the variation of the dimensions of the product to be dispensed, and optimizing the loading of the machine; additionally, at least one of the walls has a shaped recess which partially contains the helical element in order to prevent its misalignment during rotation.

According to the invention, the product has at least one of its dimensions greater than the diameter of the helix, with a surface capable of bearing, at least at one point, against at least one of the walls of the dispensing chamber.

In the dispensing device according to the invention, the product is automatically fed in an ordered way to the helix by bulk product containing means provided with a descending duct orientated to ensure that the product falls correctly between two adjacent turns of the upper end. The product is placed by striking one of the walls of the dispensing chamber.

BRIEF DESCRIPTION OF THE DRAWING

The above and other objects, features and advantages of my invention will become more readily apparent from the following description, reference being made to the accompanying highly diagrammatic drawing in which.

SPECIFIC DISCRIPTIONS

Figure 1:
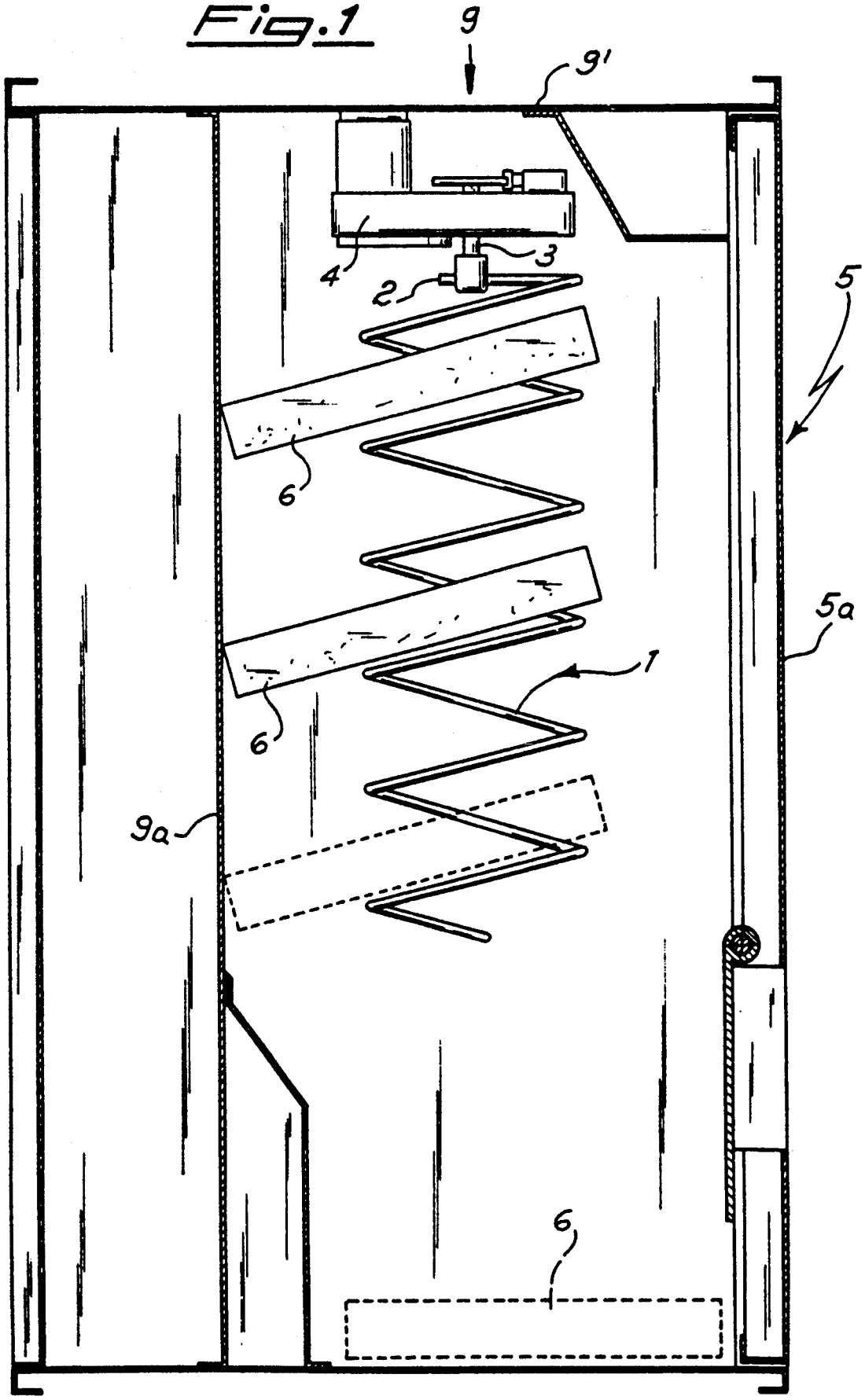
FIG. 1 is a side elevational view of the dispensing device according to the invention applied to a machine.

As shown in FIG. 1, the dispensing device according to the invention substantially comprises an element or coil 1 with helical turns spaced apart and having an upper end which is horizontal and capable of engaging with a shaft 3 of a motor 4 of a known type, which is to be fixed by known means to the top wall 9' of the housing 9 of the dispensing machine 5.

Figure 2:
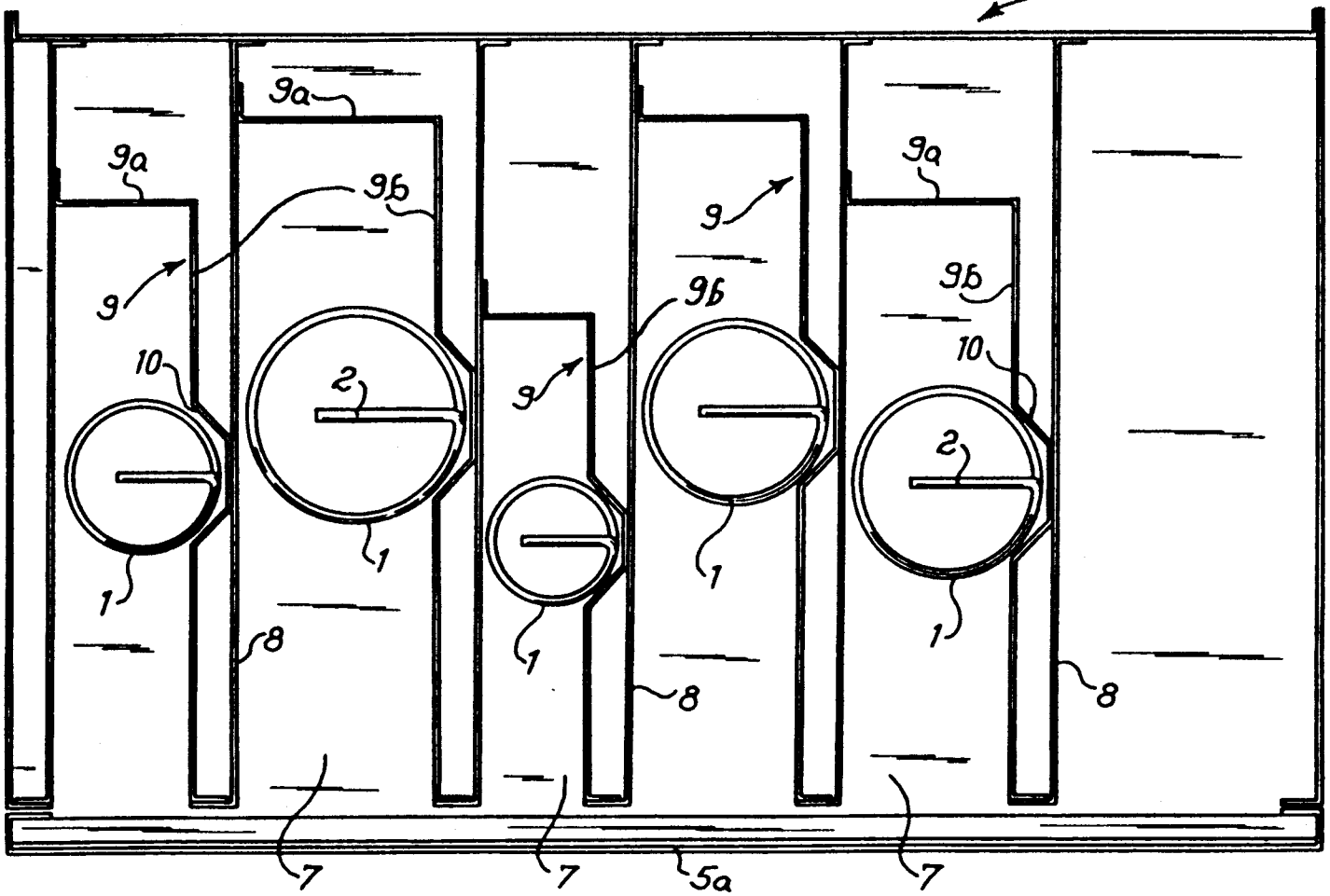
FIG. 2 is a plan view of a dispensing machine with dispensing devices according to the invention.
Figure 3A:
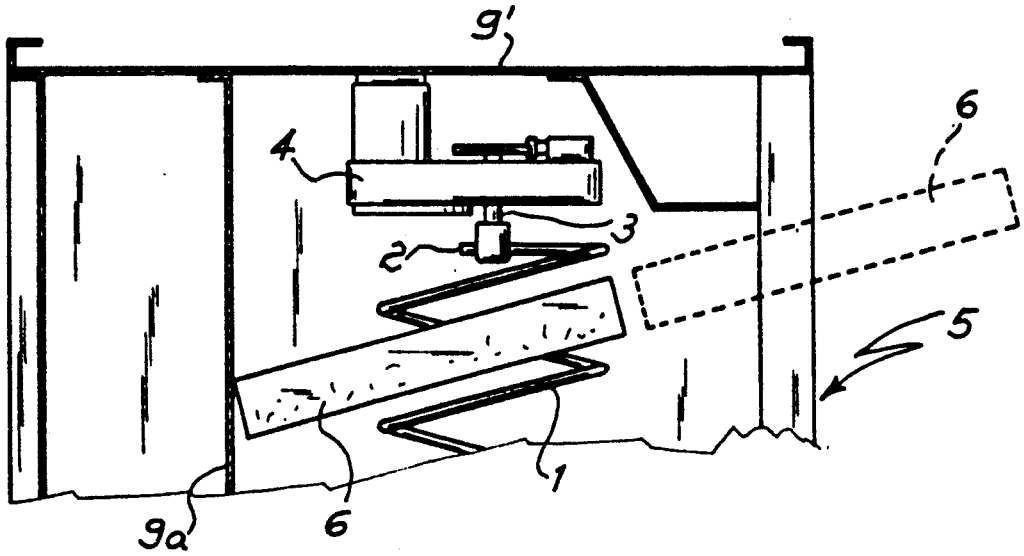
FIG. 3*a* is a schematic view of the manual loading of the product with a hatch open.
Figure 3B:
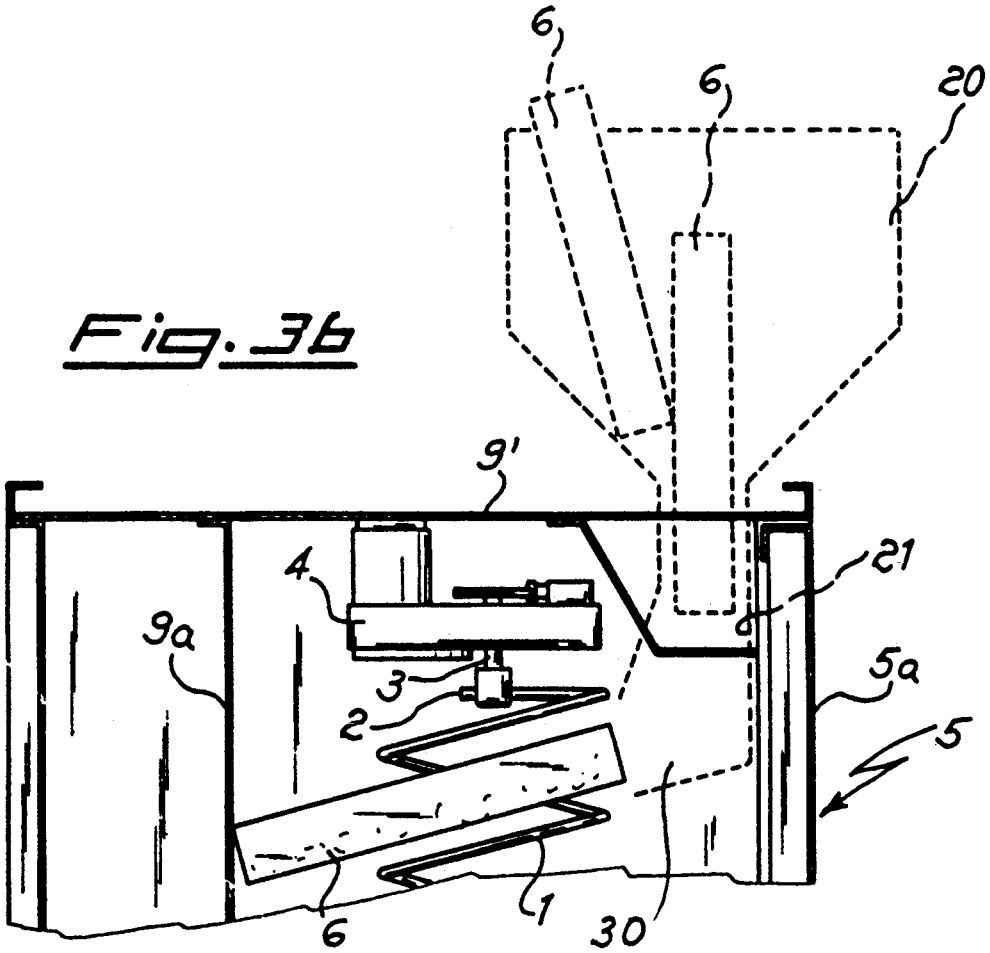
FIG. 3*b* is a partial schematic view of the machine illustrating automatic feed of the product to the helix.

FIG. 2 shows a possible arrangement within the same machine 5 with more than one dispensing area 7. Each dispensing area is provided with a core 1 element having helical turns contained within a volume formed by a first movable wall 8 which is substantially rectilinear and by a second partition 9*a*, 9*b* which is also movable, and consists of a first side 9*a* and a second side 9*b* perpendicular to the first. By sliding the various walls 8 and partitions 9*a*, 9*b* relative to each other it is possible to form dispensing chambers whose volumes correspond to the different volumes of the packages to be dispensed, thus optimizing the load capacity of the machine while retaining the same overall dimensions of the machine. On the wall 9*a*, 9*b* of the partition 9 there is additionally a recess 10 which partially contains the helical element 1 and has the double function of preventing any misalignment of the coil 1 with helical turns due to an unbalanced loading of products. With the machine 5 stopped and the hatch 5*a* open (FIG. 3*b*) the correct volume of the dispensing chamber 7 is created by moving the walls 8 and 9, and the objects 6 are loaded in an ordered way in all of the spaces between adjacent turns of the helical element 1. As a variant and as shown schematically in FIG. 3*b*, it is possible to load the upper turns of the helical element 1 automatically by means of a hopper 20 fitted with a descending duct 21 orientated in such a way as to allow the product to fall correctly on to the supporting turn and to be stopped by the opposite wall 9*a*.

On insertion of the coin or the like, the motor makes the programmed number of rotations necessary to cause the helix 1 to make a complete rotation so that each package 6 present in the helical element, bearing against at least one of the walls 9*a*, 9*b*, which form the dispensing chamber 7, is impelled downwards by the helix until the package present on the lowest turn is disengaged from the helix and falls into the underlying area for collection by the user.

It is evident from the description of the dispensing device according to the invention that it is possible to dispense any packaged product of any shape subject under the condition only that it must have at least one side which projects from the spiral and must be shaped so that it has at least one point capable of bearing against at least one of the said walls of the dispensing chamber in such a way as to oppose the rotational force exerted by the helix on the product, which tends to rotate in a substantially horizontal plane, and in such a way as to enable the package to descend by sliding on the rotating spiral.

Many variations may be introduced without thereby going beyond the scope of the invention in its general characteristics.

What is claimed is:

1. A device for dispensing packaged products, said device comprising:

a housing formed with a pair of spaced apart vertical side walls bridged by a top cross wall;

at least one pair of sliding walls between said side walls extending downwardly from said cross wall and forming a dispensing chamber having generally a U-shaped cross-section and formed with a top and a discharge bottom;

a motor mounted on the housing with an output shaft extending into said chamber and terminating close to the top thereof;

at least one elongated helical coil centered on a vertical axis and formed with a helix angle and operatively connected with said shaft in said chamber, said helical coil being formed with a plurality of turns between said top and bottom of said chamber and receiving a product to be dispensed between adjacent turns, said coil having a diameter larger than at least one dimension of the product, the product having a length larger than said one dimension;

means forming a first duct receiving said coil in said chamber and including:

a vertical first wall extending parallel to said sliding walls and being formed with a recess extending outwardly toward one of said sliding walls and receiving a portion of said helical coil thereby preventing misalignment of said coil between said top and bottom of the chamber, and a vertical guiding wall extending perpendicular to said first wall and being in contact with the other one of said sliding walls, said guiding wall of said duct abutting the products received between said turns and urged against said guiding wall by gravity acting thereon, so that said products are guided toward said discharge bottom of said chamber by rotation of said coil and are prevented from rotating by said guiding wall.

2. The device defined in claim 1, further comprising loading means formed with a guiding ramp extending into said duct close to the top of the chamber at said helix angle for delivering the products to be dispensed between turns of the coil.

3. The device defined in claim 1, further comprising:

another sliding wall between said side walls spaced from one of said pair of sliding walls at a distance different from a distance between said one pair of sliding walls for forming another chamber having a U cross-section;

another spring coil in said other chamber having a respective diameter different from the diameter of said the first-mentioned coil for transporting products having a length different from the length of the product transported in the first-mentioned said one chamber; and a respective duct in said other chamber formed with a respective guiding wall juxtaposed with one of the sliding walls of said one pair and a respective second wall formed with a respective recess receiving a portion of said other coil in said second chamber and extending outwardly toward said other sliding wall.

4. The device defined in claim 1 wherein said recess is formed with a bottom face thereof, said bottom face being in continuous contact with the respective sliding wall.

5. The device defined in claim 1 wherein said first and guiding walls of said duct are unitary with one another.

* * * * *